United States Patent [19]

Kimura et al.

[11] 4,190,836

[45] Feb. 26, 1980

[54] DYNAMIC DRIVE CIRCUIT FOR LIGHT-EMITTING DIODES

[75] Inventors: Hiroyuki Kimura, Yokohama; Isao Fukushima; Shin-Ichi Ohashi, both of Fujisawa; Yoshinori Masuda, Katsuta, all of Japan

[73] Assignee: Hitachi, Ltd., Japan

[21] Appl. No.: 847,802

[22] Filed: Nov. 2, 1977

[30] Foreign Application Priority Data

Nov. 15, 1976 [JP] Japan ..... 51/136293
Nov. 15, 1976 [JP] Japan ..... 51/136294

[51] Int. Cl.[2] ..... G09F 9/32

[52] U.S. Cl. ..... 340/762; 307/246; 340/166 EL; 340/782; 340/802; 340/811

[58] Field of Search ..... 340/336, 339, 324 M, 340/166 EL, 762, 782; 358/59, 241; 307/246

[56] References Cited

U.S. PATENT DOCUMENTS

| | | | |
|---|---|---|---|
| 3,388,292 | 6/1968 | Burns | 340/782 |
| 3,564,135 | 2/1971 | Weimer | 358/241 |
| 3,742,260 | 6/1973 | Boudry | 307/246 |
| 3,833,833 | 9/1974 | Nelson | 340/336 X |
| 3,990,070 | 11/1976 | Spence | 340/762 X |
| 4,011,557 | 3/1977 | Chetelat et al. | 340/336 |
| 4,070,663 | 1/1978 | Kanatani et al. | 340/324 M |
| 4,110,662 | 8/1978 | Greeneich et al. | 340/782 X |

*Primary Examiner*—David L. Trafton
*Attorney, Agent, or Firm*—Craig and Antonelli

[57] ABSTRACT

In a dynamic drive circuit for light-emitting diodes, at least one of the rise and fall times of the current flowing through the light-emitting diode is elongated to reduce the higher harmonic components contained in the current.

20 Claims, 11 Drawing Figures

DYNAMIC DRIVE CIRCUIT FOR LIGHT-EMITTING DIODES

LIST OF PRIOR ART REFERENCES (37 CFR 1.56 (a))

The following references are cited to show the state of the art:

(1) Japanese Utility Model Publication No. 5305/75, Kishimoto et al, Feb. 14, 1975

(2) Mimura, "Light-Emitting Diodes And Drive Circuits", the Japanese Journal "Densi Gijitsu", October 1972, Vol. 14, No. 11, pp. 31–35

BACKGROUND OF THE INVENTION

This invention relates to a drive circuit for light-emitting diodes (hereafter referred to as LEDs) used as digital display elements in a digital instrument, and more particularly to such a drive circuit of a dynamic drive type.

The recent development of digital techniques has put into practice the with digital displays (for example, of time in watches, or of frequency being received in radio receivers or tranceivers) by the use of 7-segment display units.

For driving such 7-segment display units the two methods of static drive and dynamic drive (pulsed energization) are generally used. The static drive type is usually recommended in the case where one or two digits are to be displayed, while the dynamic drive type is preferred in terms of economizing circuit elements in the case where two or more digits are to be displayed. This is because the number of LED drive switches (and hence their associated wiring circuits) required for the display of N digits each having seven LEDs for 7 segments and one LED for a decimal point is 8N in the static drive method and (8+N) in the dynamic drive method.

In a drive circuit employing such a dynamic drive method, the corresponding segments or LEDs of the respective digits are connected in common and there are provided segment switches for selecting the segments and character switches for selecting the digits. Each segment is connected in series with the associated segment switch and character switch, and the segment switches and the character switches are controlled in a time-division manner. Accordingly, there is a drawback that the current flowing through the LED upon the turn-on of the segment or character switch changes pulsewise or stepwise so that the higher harmonics contained in the pulse-like current cause reception disturbance in a receiver.

SUMMARY OF THE INVENTION

An object of this invention is to provide an LED drive circuit capable of suppressing the reception disturbance signal generated from LEDs when they are driven.

To that end, the LED drive circuit according to this invention incorporates therein circuit means which elongates at least one of the rise and fall times of the current flowing through the LED to decrease the higher harmonic components contained in the current.

DESCRIPTION OF THE PREFERRED EMBODIMENTS

Figure 1:
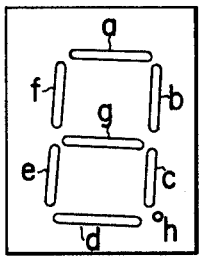
FIG. 1 schematically shows a 7-segment display unit.
Figure 2:
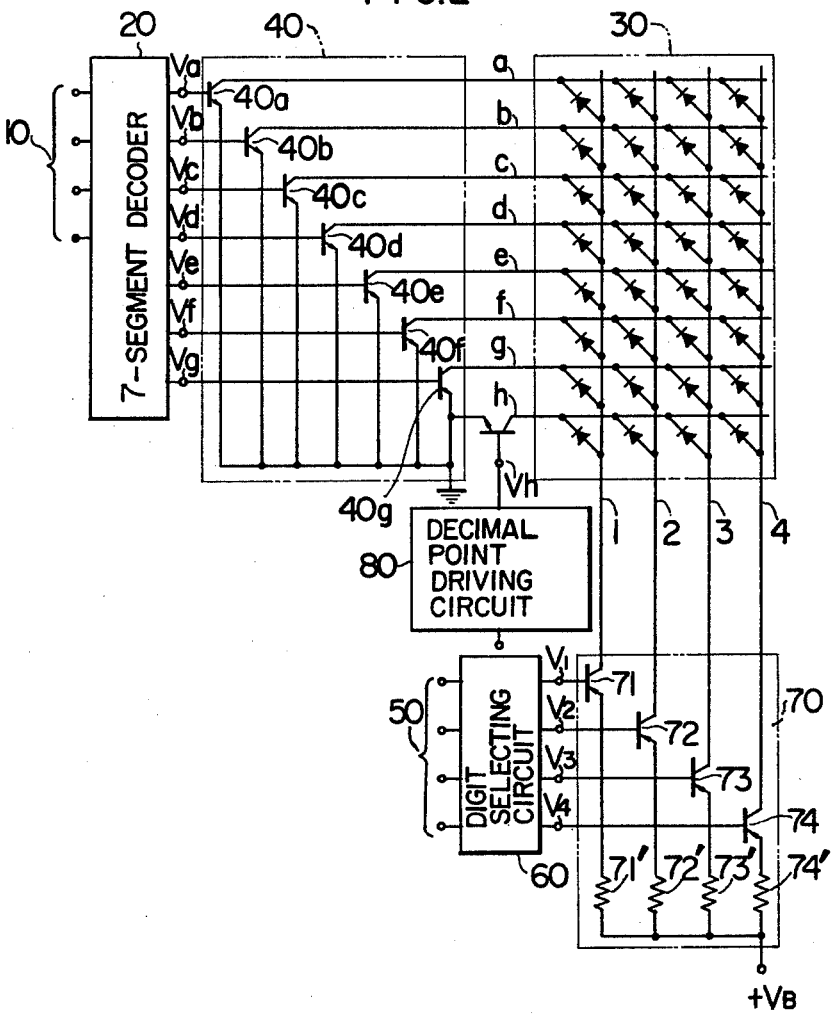
FIG. 2 shows a drive circuit for the 7-segment display unit.

This invention will be described below on the basis of a conventional dynamic drive circuit for a 4-digit display such as shown in FIG. 2. A conventional 7-segment display unit as shown in FIG. 1 comprises seven LEDs a–g for 7-segments and one LED h for a decimal point.

In the drive circuit shown in FIG. 2, reference numeral 10 designates 4-digit signal input terminals, numeral 20 a 7-segment decoder for decoding the 4-digit signal into a 7-segment signal, numeral 30 a 7-segment 4-digit display device for displaying a 4-digit number by LEDs a–h', numeral 40 a segment drive circuit which includes seven segment switches or switching transistors 40*a*–40*g* connected between the seven output terminals $V_a$–$V_h$ of the segment decoder 20 and the cathodes of the LEDs a–h of the display device 30 and which is controlled by the segment signals from the 7-segment decoder 20 so as to control the LEDs a–h of the display device 30, numeral 50 digit signal input terminals, numeral 60 a digit selecting circuit, and numeral 70 a character drive circuit which includes four character switches or switching transistors 71, 72, 73 and 74 connected between the 4 output terminals $V_1$–$V_4$ of the digit selecting circuit 60 and the anodes of the LEDs a–h of the display device 30 and which is controlled by the outputs of the digit selecting circuit 60 so as to control the digits of the display device 30. The character switches 71, 72, 73 and 74 of the character drive circuit 70 are repeatedly switched in the mentioned order 71→72→73→74→71 . . . ). Reference numeral 80 designates a decimal point drive circuit which is a switch or switching transistor 80*h* connected with the cathodes side of the LEDs h of the display device 30.

With this circuit configuration, when the character switch 71 connected with the anodes of the LEDs a–h belonging to the first digit is turned on while among the segment switches 40*a*–40*g* connected with the cathodes of the LEDs a–g the switches 40*b* and 40*c* are, for example, turned on, the first digit of the display device 30 gives "1". Then, if the character switch 72 for the second digit is turned on while the segment switches 40*a*, 40*b*, 40*g*, 40*e* and 40*d* are turned on, the second digit of the display device 30 gives "2". In like manner, the first to fourth digits are sequentially and repeatedly displayed at such a high speed that the displayed 4-digit number appears to the human eye as if it is continuously displayed.

Now, description will be given as to how the LEDs a–g are energized.

Figure 3:
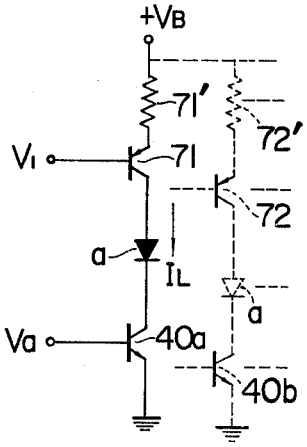
FIG. 3 PRIOR ART
FIG. 3 shows a conventional LED drive circuit.

FIG. 3 shows a part of the first display circuit shown in FIG. 2. As shown in FIG. 3, the character switching transistor 71 has its emitter connected with a power source $+V_B$ through a current limiting resistor 7', its collector connected with the anode of the LED a and its base connected with the output terminal $V_1$ of the digit selecting circuit 60. The segment switching transistor 40a has its collector connected with the cathode of the LED a, its emitter directly grounded and its base connected with the output terminal $V_a$ of the 7-segment decoder 20.

Figure 4:
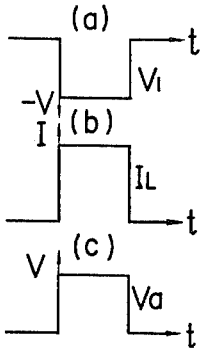
FIG. 4 PRIOR ART
FIG. 4 shows the drive voltage and current waveforms in the circuit of FIG. 3.

When the outputs of the 7-segment decoder 20 and the digit selecting circuit 60, e.g. voltages $V_a$ and $V_1$ are shown in (a) and (c) of FIG. 4 are supplied to the bases of the transistors 40a and 71, the transistors 40a and 71 are both turned on so that a current $I_L$ as shown in (b) of FIG. 4 flows through the LED a to cause the LED a to luminesce.

According to this dynamic drive method, however, since the segment switches 40a–40g and the character switches 71–74 are controlled in a well-known time-division manner, the currents which flow through the LEDs a–h take pulse-like forms so that the above-described drawbacks are caused.

Figure 5:
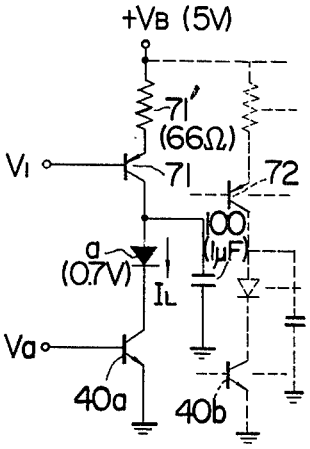
FIG. 5 shows an LED drive circuit as an embodiment of this invention.

FIG. 5 shows a circuit serving one embodiment of this invention devised to eliminate these drawbacks. In FIGS. 3 and 5, the equivalent parts or elements are indicated by the same reference numerals or symbols. In the improved circuit of FIG. 5, a capacitor 100 has one end connected with the anode of the LED a and the other end directly grounded. In this circuit, the voltages $V_1$ and $V_a$ to be applied to the transistors 71 and 40a are adjusted as shown in (a) and (c) of FIG. 6. Namely, the transistor 40a starts conducting at the instant $t_1$ earlier than the instant $t_2$ at which the transistor 71 starts conducting and the cut-off instant $t_4$ of the transistor 40a occurs later than the cut-off instant $t_3$ of the transistor 71. Thus, the conducting period of the transistor 40a is set to be longer than that of the transistor 71. This is made so by suitably adjusting the transistor driving circuits (i.e. 7-segment decoder, digit selecting circuit etc.) connected with the bases of the transistors 40a and 71.

The instant $t_1$ of starting the conduction of the transistor 40a is made earlier than the instant $t_2$ of starting the conduction of the transistor 71 since the residual charges in the capacitor 100 must be discharged through the LED a and the transistor 40a before the transistor 71 starts conducting. In other words, the purpose is to prevent the charging current through the transistor 71 into the capacitor from overlapping the discharging current from the capacitor 100 through the LED a and the transistor 40a. Otherwise, spike currents causative of noise may be generated due to the overlap of the charging and discharging currents and may flow through the LED a.

The operation of the circuit shown in FIG. 5 will next be described. During a period $T_1$ in FIG. 6, the transistor 40a is conducting while the transistor 71 remains cut off and the residual charge in the capacitor 100 is released through the LED a and the transistor 40a. The discharging charges amount to so small a value that the LED a is not lit up.

Figure 6:
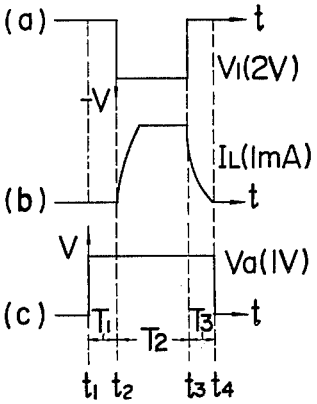
FIG. 6 shows the drive voltage and current waveforms in the circuit of FIG. 5.

During another period $T_2$ in FIG. 6, the transistors 40a and 71 are both conducting and a current flows from the power source through a resistor 71', the transistor 71, the LED a and the transistor 40a to light up the LED a. In this case, the constant current having flown through the transistor 71 also charges the capacitor 100.

The current $I_L(t)$ flowing through the LED a is given by the following expression:

$$I_L(t)=I_o\{1-\exp(-t/CR)\}$$

Here, $I_o$ is the value of the current flowing through the collector of the transistor 71 (constant current circuit), R is the total value of the conducting resistances of the LED a and the transistor 40a and C is the capacitance of the capacitor 100. The transient rising portion of the current $I_L(t)$, having a waveform as shown in (b) of FIG. 6, increases with a time constant of T=CR.

During a period of $T_3$ shown in FIG. 6, the transistor 40a is conducting and the transistor 71 is cut off. The charging of the capacitor 100 is completed and then the charge stored in the capacitor 100 is discharged through the LED a and the transistor 40a. At this time, the current $I_L$ through the LED a decreases exponentially as shown in (b) of FIG. 6. When both the transistors 71 and 40a are cut off, no current flows so that the charging and discharging of the capacitor 100 is stopped.

In this way, by controlling the current $I_L$ flowing through the LED a in such a manner that its rising and falling portions vary with certain time constants as shown in (b) of FIG. 6, the higher harmonic components which can cause harmful disturbances against, for example, receivers can be reduced.

Figure 7:
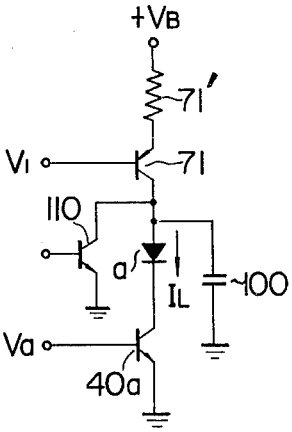
FIGS. 7 and 8 show variation of the circuit shown in FIG. 5.
Figure 8:
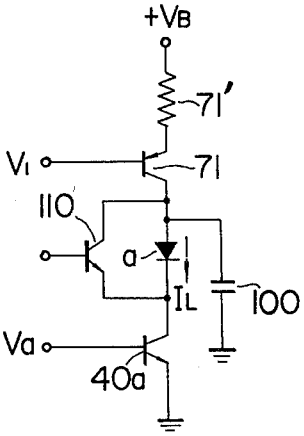

FIGS. 7 and 8 show variations of the embodiment of this invention shown in FIG. 5. In FIGS. 7 and 8, bypass transistors 110 are connected in parallel with the capacitor 100 and the LED a respectively and the associated drive circuits (not shown) are provided. Thus, the transistor 110 is turned on only when the transistor 71 is cut off and the transistor 40a is conducting, so that the discharging of the capacitor 100 is made faster, that is, the frequencies of the time-division signals (as shown in (a) and (c) of FIG. 6) for driving the transistors 71 and 40a can be increased. This means that the frequency of luminescence of the LED a is increased and therefore the display becomes brighter and clearer.

Figure 9:
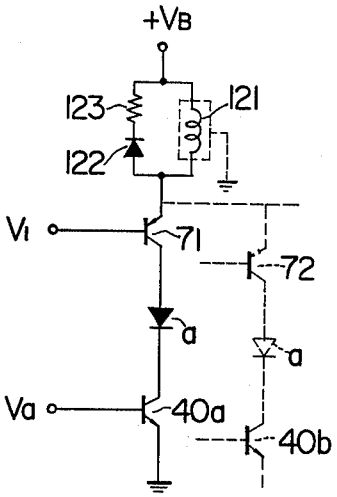
FIG. 9 shows an LED drive circuit as another embodiment of this invention.

FIG. 9 shows a circuit of another embodiment of this invention. In FIG. 9, the emitter of the character switching transistor 71 is connected with the power source $+V_B$ and an inductance 121 is shunted by a series circuit of a diode 122 and a resistor 123. The remaining portions of the circuit in FIG. 9 are the same as the corresponding parts of the circuit in FIG. 5, and the equivalent parts and elements are indicated by the same reference numerals or symbols. Accordingly, description of these equivalent elements will be omitted.

Figure 10:
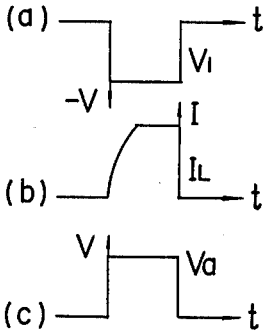
FIG. 10 shows the drive voltage and current waveforms in the circuit of FIG. 9.

With this circuit configuration as shown in FIG. 9, when voltages $V_1$ and $V_a$ of (a) and (c) of FIG. 10 similar to those applied to the conventional circuit shown in FIG. 3 are applied to the bases of the transistors 71 and 40a, both the transistors 71 and 40a are turned on to cause a current to flow through the LED a, the current being given by the following expression:

$$I_L(t)=(E/R)(1-\exp(-L/Rt))$$

Here, E is the voltage of the power source, L is the value of the inductance and R is the total value of the resistances of the inductance 121, the LED a and the transistors 71 and 40a in conduction. The circuit through the LED a has its waveform during the transient rise time shown in (b) of FIG. 10 and also increases with a time constant of $T=L/R$. Thus, the higher harmonics due to the transient rise of the current can be reduced.

When the voltages $V_1$ and $V_a$ vanish, the transistors 71 and 40*a* are cut off. At this time, the energy stored in the inductance 121 begins to be discharged to develop a counter e.m.f. in the form of a pulse across the inductance 121. This counter e.m.f., however, is absorbed by the diode 122 and the resistor 123 and vanishes.

Figure 11:
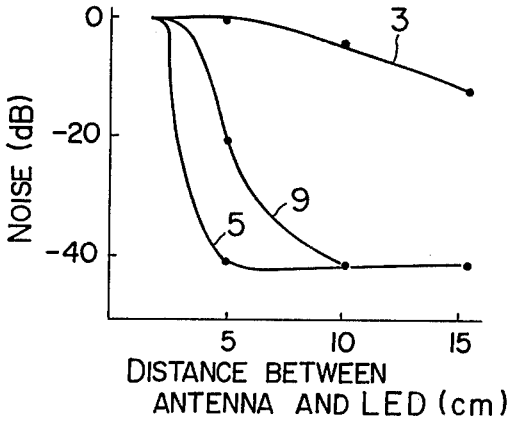
FIG. 11 shows the characteristic curves illustrating the effect of this invention.

FIG. 11 shows the relationships between the noise level and the distance from the display device to the bar-antenna of an AM receiver, observed when the LED drive circuits shown as a conventional example in FIG. 3 and as embodiments of this invention in FIGS. 5 and 9 are approaching the AM receiver. In FIG. 11, curve (3) corresponds to the characteristic of the conventional drive circuit shown in FIG. 3 and curves (5) and (9) respectively represent the characteristics of the drive circuits shown as the embodiments of this invention in FIGS. 5 and 9.

It is therefore understood from FIG. 11 that according to this invention the noise can be significantly decreased in comparison with the conventional drive circuit.

We claim:

1. In a dynamic drive circuit for light-emitting diodes, comprising anode drive switching means connected with the anodes of said light-emitting diodes, cathode drive switching means connected with the cathodes of said light-emitting diodes, and a power source connected through said anode and cathode drive switching means with said light-emitting diodes, said anode and cathode drive switching means being repeatedly turned on and off in a time-division manner to drive said light-emitting diodes with a pulsed current in a time-division manner, the improvement further comprising a time constant control means for delaying the rise time of pulses of the current flowing through said light-emitting diode to reduce higher harmonic components contained in the rising current portion of said pulses of current.

2. A dynamic drive circuit according to claim 1, wherein said time constant control means includes a capacitor which is connected between the anode of said light-emitting diode and a reference potential to shunt a series circuit of said light-emitting diode and the associated cathode drive switching means and which is charged by the current flowing through said anode drive switching means upon the turn-on thereof and discharges the charged current through said light-emitting diode and said cathode drive switching means at the cut-off state of said anode drive switching means and at the conducting state of said cathode drive switching means, thereby providing delays, respectively, to both the rise and fall times of the current through sad light-emitting diode.

3. A dynamic drive circuit according to claim 2, wherein said anode and cathode driving switching means includes switching transistors.

4. A dynamic drive circuit according to claim 2, wherein said time constant control means further includes a discharging means connected in parallel with said capacitor for promoting the discharge of said capacitor.

5. A dynamic drive circuit according to claim 2, wherein said time constant control means further includes a discharging means connected in parallel with said light-emitting diode, said discharging means turning on upon the discharge of said capacitor to promote the discharge of said capacitor.

6. A dynamic drive circuit according to claim 4, wherein said discharging means is a switching transistor which is turned on when said anode drive switching means is cut off and said cathode drive switching means is turned on.

7. A dynamic drive circuit according to claim 5, wherein said discharging means is a switching transistor which is turned on when said anode drive switching means is cut off and said cathode drive switching means is turned on.

8. A dynamic drive circuit according to claim 1, wherein said time constant control means includes a parallel circuit of an inductance and a diode, said inductance being connected between said anode drive switching means and a reference potential to delay the rise time of the current flowing from said first power source to said light-emitting diode when said anode drive switching means is turned on, and said diode consuming the counter e.m.f. generated by said inductance when said anode drive switching means is cut off.

9. A dynamic drive circuit according to claim 8, wherein said anode and cathode drive switching means include switching transistors.

10. A dynamic drive circuit according to claim 1, wherein said time constant control means includes a capacitor connected between the anode of said light-emitting diode and a reference potential, so that said capacitor is charged by said power source when said anode drive switching means is on, said charging of said capacitor causing the delay in the rise time of the pulses of current flowing through said light-emitting diode.

11. A dynamic drive circuit according to claim 1, wherein said time constant control means further includes means for rendering said cathode drive switching means conductive for a period of time which is longer than and inclusive of a period of time for which said anode drive switching means is conductive for.

12. In a dynamic drive circuit for driving light-emitting diodes, comprising anode drive switching means connected with the anodes of said light-emitting diodes, cathode drive switching means connected with the cathodes of said light-emitting diodes, and a power source connected through said anode and cathode drive switching means with said light-emitting diodes, said anode and cathode drive switching means being repeatedly turned on and off in a time-division manner to drive said light-emitting diodes in the time-division manner, the improvement comprising:

a conducting period control means for rendering the conductive period of said cathode drive switching means longer than that of said anode drive switching means in terms of at least one of their conduction-start instants and their cut-off instants; and a capacitance element which is connected between the anode of said light-emitting diode and ground to form a parallel circuit with a series circuit of said light-emitting diode and the associated cathode drive switching means and which is charged by the current flowing through said anode drive switching means upon the turn-on thereof and discharges the charged current through said light-emitting diode and said cathode drive switching means at the cut-off state of said anode drive switching means and at the conducting state of said cathode drive switching means, so that predetermined time constants are respectively provided to the rising and falling portions of the drive current flowing to said light-emitting diode at the conducting states of both said anode and cathode drive switching means, so that higher harmonic components contained in the rising and falling current portions are reduced.

13. A dynamic drive circuit according to claim 12, wherein said anode and cathode driving switching means include switching transistors, and said conducting period control means includes a segment decoder and a digit selecting circuit coupled to said switching transistors.

14. A dynamic drive circuit according to claim 12, wherein said improvement further includes a discharging means connected in parallel with said capacitance element and operatively rendered on at the turn-on state of said cathode drive switching means and the cut-off state of said anode drive switching means for hastening the discharge of said capacitance element.

15. A dynamic drive circuit according to claim 12, wherein said improvement further includes a discharging means connected in parallel with said light-emitting diode, said discharging means being turned on at the turn-on state of said cathode drive switching means and the cut-off state of said anode drive switching means to hasten the discharge of said capacitance element.

16. In a dynamic drive circuit for driving light-emitting diodes, comprising anode drive switching means connected with the anodes of said light-emitting diodes, cathode drive switching means connected with the cathodes of said light-emitting diodes, and a power source connected through said anode and cathode drive switching means with said light-emitting diodes, said anode and cathode drive switching means being repeatedly turned on and off in a time-division manner to drive said light-emitting diodes in the time-division manner, the improvement comprising a parallel circuit of first and second means, said first means being connected between said anode drive switching means and said power source to delay the rise time of the current flowing from said power source to said light-emitting diode when said anode drive switching means is turned on, and said second means consuming the counter e.m.f. generated by said first means when said anode drive switching means is cut off.

17. A dynamic drive circuit according to claim 16, wherein said anode and cathode drive switching means include switching transistors, said first means includes an inductance and said second means includes a diode.

18. In a dynamic drive circuit for driving a light-emitting diode, comprising a first drive switching means connected in series with said light-emitting diode, second drive switching means connected in series with a series circuit of said first drive switching means and said light-emitting diode, a power source connected with a current path which is formed by the series connection of said second drive switching means and the series circuit of said first drive switching means and said light-emitting diode, first control means for repeatedly turning on said first drive switching means for a first predetermined period of time, and second control means for repeatedly turning on said second drive switching means for a second predetermined period of time, so that a pulsed current flows from said power source through said current path when said first and second drive switching means are concurrently turned on, the improvement comprisng:

said second control means rendering said second drive switching means on for the second period which is equal to or shorter than the first period and which is completely included within the first period;

first means for causing the pulsed current flowing in said current path at the commencement thereof to rise with a predetermined time constant; and second means for suppressing oscillation of said pulsed current at the termination of each pulse;

so that harmonic components contained in said pulsed current at the commencement and termination of each pulse are substantially eliminated.

19. The improvement in the dynamic drive circuit according to claim 18, wherein said second control means operatingly turns on said second drive switching means in such a manner that the on period commences after the commencement of the first period and terminates before the termination of the first period, and there is provided a capacitor connected in parallel with the series circuit of sad first drive switching means and said light-emitting diode so that the capacitor is charged by the pulsed current flowing in said current path when said first and second drive switching means are concurrently turned on to thereby act as the first means and that the capacitor discharges the charge stored therein through said series circuit of the first drive switching means and said light-emitting diode when the first drive switching means is turned on but the second drive switching means is turned off to thereby act as said second means, so that the harmonic components contained in the pulsed current flowing through said light-emitting diode are substantially eliminated.

20. The improvement in the dynamic drive circuit according to claim 18, wherein said first means comprises an inductance element connected in series in said current path, and said second means comprises a diode and a resistance element connected in series with said diode to form a series circuit therewith, which series circuit is connected in parallel with said inductance element in such a manner that the diode is directed in an opposite conducting direction to that of the light-emitting diode, so that a counter e.m.f. developed in said inductance element when at least one of said first and second drive switching means is turned off is absorbed by said resistance element through said diode.

* * * * *